US005461352A

United States Patent [19]

Noguchi et al.

[11] Patent Number: 5,461,352

[45] Date of Patent: Oct. 24, 1995

[54] CO-PLANAR AND MICROSTRIP WAVEGUIDE BANDPASS FILTER

[75] Inventors: Yasumasa Noguchi, Nara; Hideyuki Miyake, Matsubara; Junya Ishii, Ikeda; Yukihiro Takeda, Kashihara, all of Japan

[73] Assignee: Matsushita Electric Industrial Co., Ltd., Osaka, Japan

[21] Appl. No.: 125,841

[22] Filed: Sep. 24, 1993

[30] Foreign Application Priority Data

Sep. 24, 1992 [JP] Japan ..... 4-254299

[51] Int. Cl.[6] ..... H01P 1/20

[52] U.S. Cl. ..... 333/204; 333/238

[58] Field of Search ..... 333/203, 204, 333/205, 219, 238, 246

[56] References Cited

U.S. PATENT DOCUMENTS

| | | | |
|---|---|---|---|
| 2,760,169 | 8/1956 | Engelmann | 333/204 |
| 4,012,705 | 3/1977 | Prevot | 333/167 |
| 4,266,206 | 5/1981 | Bedard et al. | 333/204 |
| 4,578,656 | 3/1986 | Lacour et al. | 333/204 |
| 4,835,499 | 5/1989 | Pickett | 333/205 |
| 5,142,255 | 8/1992 | Chang et al. | 333/219 X |
| 5,192,926 | 3/1993 | Sogo et al. | 333/204 |

FOREIGN PATENT DOCUMENTS

| | | | |
|---|---|---|---|
| 0068345 | 1/1983 | European Pat. Off. . | |
| 0285503 | 10/1988 | European Pat. Off. . | |
| 0161801 | 7/1986 | Japan | 333/204 |
| 0030402 | 2/1987 | Japan | 333/204 |
| 0140501 | 6/1987 | Japan | 333/204 |
| 0119302 | 5/1988 | Japan | 333/204 |
| 0101701 | 4/1989 | Japan | 333/204 |
| 3-121707 | 12/1991 | Japan . | |
| 0072804 | 3/1992 | Japan | 333/204 |
| 2246670A | 2/1992 | United Kingdom . | |

OTHER PUBLICATIONS

S. Toyoda, "Variable Bandpass Filters Using Varactor Diodes", IEEE Transactions on Microwave Theory and Techniques, vol. 29, No. 4 at 356–363, (Apr. 1981).

*Primary Examiner*—Robert J. Pascal
*Assistant Examiner*—Darius Gambino
*Attorney, Agent, or Firm*—Willian Brinks Hofer Gilson & Lione

[57] ABSTRACT

A bandpass filter for the transmission of signals within a predetermined frequency bandwidth having a center frequency, which provides for substantial attenuation of the harmonic components of the center frequency of the filter. The bandpass filter includes at least one resonator comprising a strip conductor and a ground conductor formed on the surface of a dielectric substrate. The strip conductor is capacitively coupled to the ground conductor so as to substantially transmit the harmonic components of the center frequency of the filter to ground.

22 Claims, 7 Drawing Sheets

CO-PLANAR AND MICROSTRIP WAVEGUIDE BANDPASS FILTER

BACKGROUND OF THE INVENTION

The present invention is directed to a bandpass filter formed on a dielectric substrate which reduces the transmission of unwanted noise.

Bandpass filters are often utilized in various types of communication equipment, for example, television receivers and cellular phones. Such filters discriminate between signals by passing signals in a desired, predetermined frequency band (i.e. pass the signal from the input to the output of the filter unattenuated), while preventing the transmission of signals outside the predetermined frequency band. In the event signals outside the desired frequency band are transmitted by the filter (i.e. the signals pass through the filter unattenuated), system performance is degraded.

FIG. 16 is a schematic plan view illustrating a prior art bandpass filter. Referring to FIG. 16, the prior art filter contains a substrate 1 formed from a dielectric substance. The dielectric substrate 1 functions as a support for three coplanar waveguide resonators 2–4, hereinafter referred to as a resonator, an input electrode 5, and an output electrode 6. Each resonator 2–4 comprises a strip conductor 2*a*–4*a*. The strip conductor 2*a* of resonator 2 is coupled to the input electrode 5 through capacitor 7. The strip conductor 4*a* of resonator 4 is coupled to the output electrode 6 through capacitor 8. Finally, strip conductor 3*a* of resonator 3 is coupled to the strip conductor 2*a* of resonator 2 and strip conductor 4*a* of resonator 4 through capacitors 9 and 10, respectively.

As is well known in the art, the frequency response of a filter defines the level of attenuation of an input signal over the entire frequency spectrum. The frequency response of the prior art bandpass filter of FIG. 16 is illustrated in FIG. 15. Specifically, FIG. 15 depicts the level of attenuation of a signal by the prior art filter which has a predetermined center frequency equal to fo. The line designated by the letter "A" represents the minimum level of attenuation acceptable for signals having a frequency outside a predefined frequency bandwidth of the filter. Frequency values 3 fo, 5 fo and 7 fo represent harmonic components of the center frequency, fo, of the filter.

As is apparent from FIG. 15, signals having a frequency equal to the harmonic components 3 fo, 5 fo and 7 fo are not adequately attenuated by the prior art filter. Although not shown, higher odd multiple harmonic components of the center frequency of the filter (i.e. 9 fo, 11 fo, etc.) also traverse the filter without adequate attenuation. Thus, the prior art filter does not sufficiently attenuate all signals having a frequency outside the filter bandwidth centered about fo, which results in the generation of noise and the degradation of the performance of a system utilizing such filters.

For example, typically a transmitter broadcasts signals of a single predetermined frequency, fo. This selective transmission is accomplished by filters, which attenuate signals having a frequency other than fo. However, if the prior art filter is used in such a transmitter, the transmitter will also output signals having a frequency equal to the odd harmonic components of fo, thereby transmitting unwanted signals (i.e. noise). Similarly, if the prior art filter is used in a receiver, it will allow for the receipt of unwanted signals having a frequency equal to the harmonic components of the center frequency of the filter (i.e. noise).

Accordingly, there exists a present need for a bandpass filter comprising coplanar waveguide resonators formed on a dielectric substrate which exhibits a frequency response that adequately attenuates the harmonic components of the center frequency of the filter so as to prevent the generation of noise.

SUMMARY OF THE INVENTION

According to this invention, a bandpass filter for the transmission of signals within a predetermined frequency bandwidth having a center frequency is provided, wherein the harmonic components of the center frequency of the filter are substantially attenuated by the filter so as to prevent the transmission of the harmonic components. The bandpass filter of the present invention comprises at least one coplanar waveguide resonator which is formed on a first surface of a dielectric substrate. The coplanar waveguide resonator comprises a strip conductor positioned between a first ground conductor so as to form a transmission line. The bandpass filter further comprises a second ground conductor formed on the first surface of the dielectric substrate. The second ground conductor is capacitively coupled to the strip conductor of the coplanar waveguide resonator, wherein the harmonic components of the center frequency of the filter are substantially transmitted to the second ground conductor so as to substantially prevent the transmission of the harmonic components by the filter.

As pointed out in greater detail below, the bandpass filter of the present invention provides important advantages over the bandpass filters of the prior art. Specifically, the transmission level of the harmonic components of the center frequency of the bandpass filter is substantially attenuated. Therefore, a system utilizing such a filter, for example, a transmitter or receiver, will exhibit a significant reduction in the noise generated by the transmission of harmonic components associated with the center frequency of the filter. This reduction in the generation of noise allows for an increase in system performance. In addition, the elements of the bandpass filter (i.e. resonators, electrodes, ground planes) can be formed on a single plane, which significantly simplifies the production process. Another advantage is that the design of the present invention allows for a reduction in the length of the resonator, which thereby allows for a reduction in the overall size of the device. The bandpass filter of the present invention can be utilized within the frequency range of approximately 400 Mhz to 3 Ghz.

The invention itself, together with further objects and attendant advantages, will best be understood by reference to the following detailed description, taken in conjunction with the accompanying drawings.

DETAILED DESCRIPTION OF THE INVENTION

Figure 1:
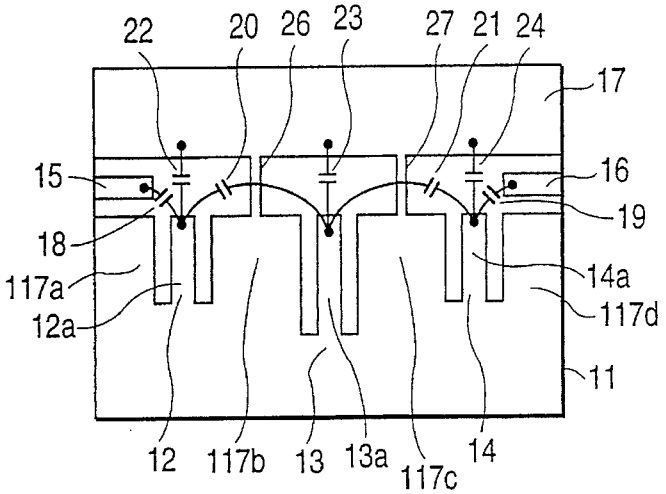
FIG. 1 is a schematic plan view of the structure of a first embodiment of the bandpass filter of the present invention.

Turning now to the drawings, FIG. 1 is a schematic plan view showing the primary part of the first embodiment of the bandpass filter of the present invention, hereinafter referred to as "the filter." As shown in FIG. 1, the first embodiment of the filter comprises a substrate 11 formed from a dielectric substance. The filter further comprises three coplanar waveguide resonators 12, 13 and 14, an input electrode 15, an output electrode 16, and a second ground conductor 17, all of which are disposed on a first surface of the dielectric substrate as shown in FIG. 1. Each coplanar waveguide resonator 12, 13 and 14 comprises a strip conductor 12*a*, 13*a*, and 14*a*, having a flat bar shape, which is positioned between first ground conductors 117*a*, 117*b*, 117*c*, 117*d*. Specifically, the strip conductor 12*a* associated with the first coplanar waveguide resonator 12 is positioned between first ground conductors 117*a* and 117*b*. The strip conductor 13*a* associated with the second coplanar waveguide resonator 13 is positioned between first ground conductors 117*b* and 117*c*. Finally, the strip conductor 14*a* associated with the third coplanar waveguide resonator 14 is positioned between first ground conductors 117*c* and 117*d*. As shown, one end of each strip conductor 12*a*, 13*a*, 14*a* is integral with the first ground conductor so as to form a one end grounded type resonator. The strip conductor may also be referred to as a center conductor.

Preferably, all the conductors such as the coplanar waveguide resonator, the input and output electrodes, and the first and second ground conductors 17 are formed from copper foil.

Furthermore, the strip conductor 12*a* of the first coplanar waveguide resonator 12 is electrically coupled to the input electrode 15 by means of a first capacitor 18. In a similar manner, the strip conductor 14*a* of the third coplanar waveguide resonator 14 is electrically coupled to the output electrode 16 by means of a second capacitor 19. The strip conductor 13*a* of the second coplanar waveguide resonator 13 is electrically coupled to strip conductors 12*a* and 14*a* by a third capacitor 20 and fourth capacitor 21, respectively. Each strip conductor 12*a*, 13*a* and 14*a* is electrically coupled to the second ground conductor 17 through a capacitor 22, 23, 24. Specifically, as shown in FIG. 1, strip conductor 12*a* is coupled to the second ground conductor 17 via capacitor 22. Strip conductor 13*a* is coupled to the second ground conductor 17 via capacitor 23. And strip conductor 14*a* is coupled to the second ground conductor 17 via capacitor 24. The values of the aforementioned capacitors vary in accordance with the desired filter performance.

A portion of the first ground conductor 117*b* situated between strip conductor 12*a* and strip conductor 13*a* extends towards the second ground conductor 17 so as to form an extending ground conductor 26. Similarly, a portion of the first ground conductor 117*c* situated between strip conductor 13*a* and strip conductor 14*a* extends towards the second ground conductor 17 so as to form an extending ground conductor 27. The extending ground conductors 26, 27 function to prevent the transmission of noise via an inherent capacitive component which functions to couple adjacent resonators to one another.

In a variation of the present embodiment, the attenuation of the noise attributable to this inherent capacitive component can be increased by lengthing the extending ground conductors 26, 27 so that each extending ground conductor is connected to the second ground conductor 17. For even further suppression of this noise component, the width of the extending ground conductors 26, 27 can be increased.

The length of the strip conductors 12*a*, 13*a*, 14*a* is selected so as to negate a shift of the center frequency of the filter caused by the presence of capacitors 22, 23 and 24 which are coupled between the strip conductors 12*a*, 13*a* and 14*a* and the second ground conductor 17, as described above.

More specifically, capacitors 22, 23 and 24 provide an increase in the capacitive component of the filter thereby causing a decrease (i.e. shift) in the center frequency, fo, of the filter. This shift in the center frequency of the filter is corrected by decreasing the inductive component of the filter by trimming the length of the strip conductors 12*a*, 13*a* and 14*a*. Accordingly, the center frequency of the filter is maintained at the desired frequency.

Alternatively, if it is desirable to reduce the length of the coplanar waveguide resonators 12, 13, 14, this can be accomplished by increasing the value of capacitors 22, 23 and 24. Specifically, an increase in the value of capacitors 22, 23 and 24 results in an increase in the capacitive component of the filter thereby decreasing the center frequency of the filter. The center frequency is restored to the desired value by a reduction in the inductive component of the filter, which is caused by reducing the length of the coplanar waveguide resonators 12, 13, 14. Furthermore, if there are any fluctuations in the length of the resonators 12, 13, 14, such fluctuations can be compensated for by varying the value of the associated capacitor 22, 23, 24. In other words, the center (i.e. resonant) frequency of the filter can be adjusted by varying the capacitive component of the filter.

Figure 5:
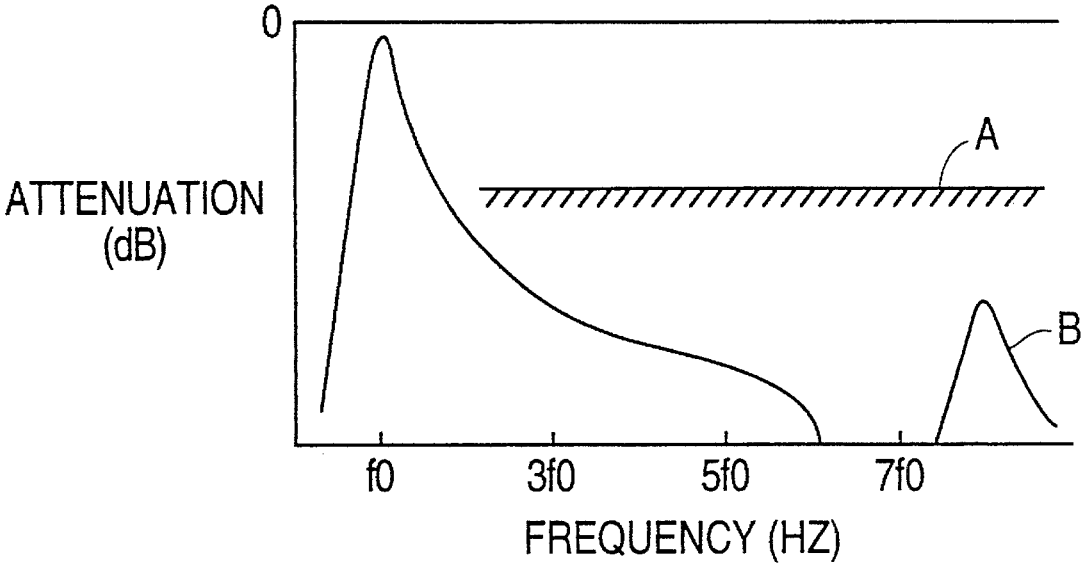
FIG. 5 is a graph illustrating the frequency response of the bandpass filter of the first embodiment of the present invention.

The frequency response of the filter of the first embodiment is shown in FIG. 5, wherein the line designated by the letter "A" represents the minimum level of attenuation acceptable for signals having a frequency outside a predefined frequency bandwidth of the filter, and the letter "B" designates a harmonic component of the center frequency of the filter. As is apparent, the lower order harmonic components (i.e 3 fo, 5 fo, 7 fo) are extremely attenuated as compared to the prior art filter described above. More specifically, the frequency response of the filter of the present invention is such that the lower order harmonics components are more attenuated than the higher order harmonic components, for example harmonic component B in FIG. 5. The increased attenuation of the harmonic components is caused by capacitors 22, 23 and 24 which function to transfer the harmonic components to the second ground conductor 17 thereby preventing the transmission of the harmonic components. As the frequency of an input signal increases, the impedance component associated with capacitors 22, 23 and 24 decreases thereby enhancing the transmission of higher frequency signals, which include harmonic components, to ground.

The magnitude of the attenuation of the harmonic components of the center frequency of the filter varies in accordance with numerous factors such as the value of the capacitors 22, 23, 24 coupling the strip conductors 12*a*, 13*a* and 14*a* to the second ground conductor 17. Specifically, as the value of these capacitors 22, 23, 24 increase, the impedance component associated with these capacitors decrease. As a result of the decreased impedance, the harmonic components of the center frequency of the filter are more readily transmitted to ground.

Accordingly, a transmitter or receiver utilizing this filter will exhibit a significant reduction in the noise generated by the transmission of harmonic components associated with the center frequency of the filter. Also, as set forth above, the extending ground conductors 26 and 27 prevent capacitive coupling between the first and second coplanar waveguide resonators 12, 13 and the second and third coplanar waveguide resonators 13, 14 thereby contributing to the suppression of noise.

In a variation of the first embodiment of the present invention, the bandpass filter can comprise a single coplanar waveguide resonator. For example, the first and second coplanar waveguide resonators 12, 13 of the first embodiment can be eliminated. In addition, the capacitors associated with the first and second coplanar waveguide resonators 12 and 13, namely the capacitors coupling the coplanar waveguide resonator to the adjacent coplanar waveguide resonator and the second ground conductor, can also be eliminated. The frequency response of this modified filter is equivalent to the frequency response of the filter of the first embodiment of the present invention.

Alternatively, the filter of the first embodiment can also comprise two or more than three of the coplanar waveguide resonators described in the first embodiment of the present invention. In addition, a filter modified as such would comprise the corresponding number of capacitors necessary for connecting the respective strip conductor of each coplanar waveguide resonator to the adjacent strip conductor, and a capacitor connecting each strip conductor to the second ground conductor as described in the first embodiment.

Other variations of the first embodiment of the present invention are also possible. For example, the strip conductors can be electrically coupled to the first ground conductor, as opposed to the second ground conductor.

In one variation of the first embodiment, when the distance between the input electrode 15 and the strip conductor 12*a* is sufficiently small, the first capacitor 18 can be replaced by the capacitance existing between the input electrode 15 and the strip conductor 12*a*. This "distance" varies in accordance with the desired characteristics of the filter. Similarly, when the distance between the output electrode 16 and the strip conductor 14*a* is sufficiently small, as defined by the filter characteristics, the second capacitor 19 can be replaced by the capacitance existing between the output electrode 16 and the strip conductor 14*a*.

In another variation, as with the first and second capacitor 18, 19, when the distance between strip conductor 12*a* and strip conductor 13*a* and between strip conductor 13*a* and strip conductor 14*a* is sufficiently small, as defined by the filter characteristics, the third capacitor 20 and the fourth capacitor 21 can be replaced by the capacitance existing between the respective strip conductors. Also, capacitors 22, 23 and 24 can be replaced by the capacitance existing between the second ground conductor 17 and the respective strip conductor 12*a*, 13*a*, 14*a*, when the distance between the second ground conductor 17 and the respective strip conductor 12*a*, 13*a*, 14*a* is sufficiently small, as defined by the filter characteristics.

In another variation, at least one of either the input electrode, the output electrode or the coplanar waveguide resonator can be disposed on the opposite surface of the substrate.

Figure 17:
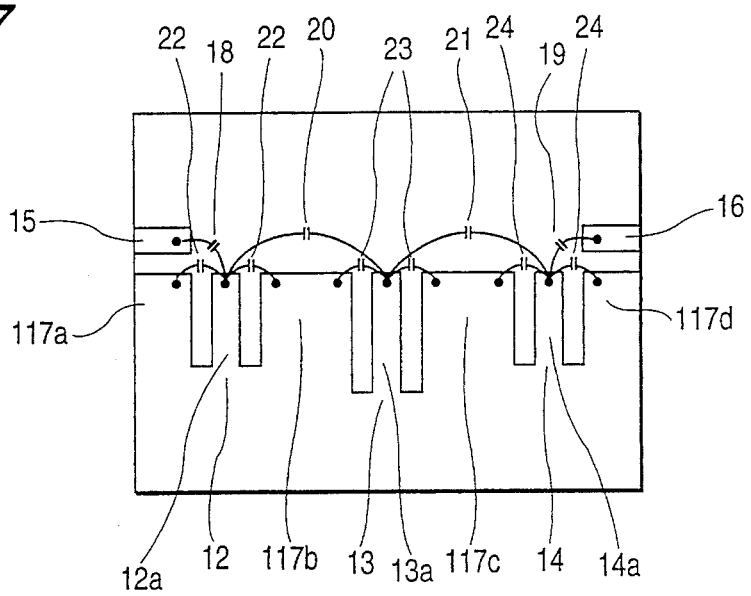
FIG. 17 is a schematic plan view of a first embodiment of a bandpass filter of the present invention having one ground conductor.

In yet another variation, it is possible to eliminate the second ground conductor if each strip conductor forming the filter is electrically coupled to the first ground conductor. As shown in FIG. 17. elements equivalent to those described above and shown in FIG. 1 are designated by the same number. As is apparent, the structure shown in FIG. 17 is the same as FIG. 1 with the exception that the structure in FIG. 17 does not have a second conductor and the capacitors 22, 23 and 24 electrically couple the strip conductor 12*a*, 13*a* and 14*a* to portions 117*a*, 117*b*, 117*c* and 117*d* of the ground conductor. More specifically, strip conductor 12*a* is coupled to the portion 117*a* and the portion 117*b* of the ground conductor through the two capacitors 22, respectively. Strip conductor 13*a* is coupled to the portion 117*b* and the portion 117*c* of the ground conductor through the two capacitors 23, respectively. Strip conductor 14*a* is coupled to the portion 117*c* and the portion 117*d* of the ground conductor through the two capacitors 24, respectively.

Finally, the electrodes and first and second ground conductors can be made of silver or other conductive materials as well as copper foil.

Figure 2:
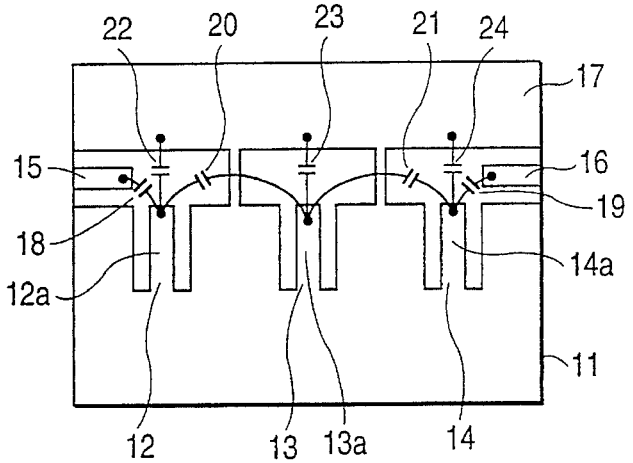
FIG. 2 is a schematic plan view of the structure of a second embodiment of the bandpass filter of the present invention.

A second embodiment of the bandpass filter of the present invention is illustrated in FIG. 2, wherein elements equivalent to those disclosed in the first embodiment are designated by the same number. As is apparent, the structure of the second embodiment of the filter is the same as the structure of the first embodiment. The difference between the two embodiments is that in the second embodiment the capacitors 22, 23 and 24, which electrically couple the strip conductors 12*a*, 13*a* and 14*a* to the second ground conductor 17 have different capacitive values. More specifically, capacitor 23 which couples strip conductor 13*a* to the second ground conductor 17 has a larger capacitive value than capacitors 22 and 24, and the strip conductor 13*a* of coplanar waveguide resonator 13 exhibits a reduction in length. The length of the strip conductor 13*a* is reduced so as to decrease the inductive component of the filter such that the resonant frequency of filter, which is a function of both the inductive and capacitive components, remains at the desired value.

The frequency response of the filter of the second embodiment of the present invention is equivalent to the frequency response of the filter of the first embodiment.

Figure 3:
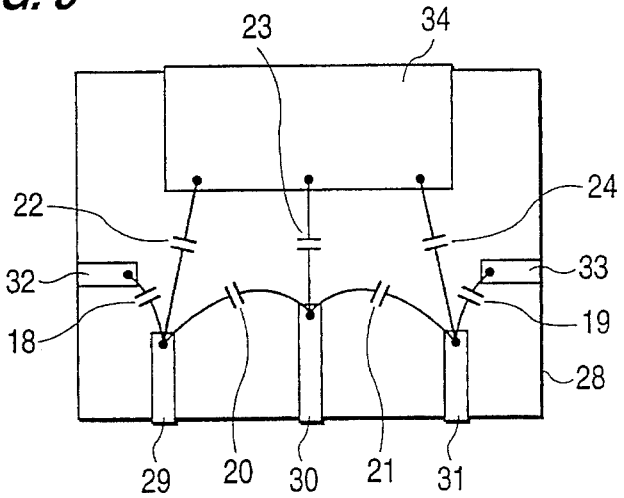
FIG. 3 is a schematic plan view of the structure of a third embodiment of the bandpass filter of the present invention.

A third embodiment of the bandpass filter of the present invention, which employs strip line type resonators, is illustrated in FIG. 3, wherein elements equivalent to those disclosed in the first embodiment are designated by the same number. As shown in FIG. 3, the bandpass filter comprises three strip conductors 29, 30, 31, preferably having a flat bar shape, disposed at specified locations on one surface of a substrate 28, as well as an input electrode 32, an output electrode 33 and a second ground conductor 34 all of which are disposed at specified locations on the same surface of the substrate 28 as the three strip conductors 29, 30, 31. The other (i.e. opposite) surface of the substrate 28 (not shown in FIG. 3) is completely covered with a first ground conductor (not shown). The combination of a strip conductor 29, 30 or 31 separated from a first conductor (not shown) by a dielectric substrate 28 is a microstrip waveguide. The strip conductors 29, 30, 31 and the second ground conductor 34 are connected at the respective proximal end to the first ground conductor disposed on the other side of the substrate 28, thereby forming resonators.

Capacitors 18–24 are arranged and operate in the same manner as the corresponding capacitor disclosed in the first embodiment of the present invention. More specifically, the strip conductor 29 and the input electrode 32 are electrically coupled through a first capacitor 18. Strip conductor 31 and the output electrode 33 are electrically coupled through a second capacitor 19. Strip conductor 30 is electrically coupled with strip conductors 29 and 31 by a third capacitor 20 and a fourth capacitor 21, respectively.

Each strip conductor 29, 30, 31 is also electrically coupled to the second ground conductor 34 through a capacitor 22, 23, 24. Specifically, as shown in FIG. 3, strip conductor 29 is coupled to the second ground conductor 34 via capacitor 22. Strip conductor 30 is coupled to the second ground conductor 34 via capacitor 23. And strip conductor 31 is coupled to the second ground conductor 34 via capacitor 24.

The frequency response of the filter of the third embodiment of the present invention is substantially equivalent to the frequency response of the filter of the first embodiment.

Similar to the first embodiment of the present invention, the filter of the third embodiment is not limited to a structure comprising three strip conductors. Variations of the third embodiment are possible wherein the filter may comprise any number of strip conductors (including a single strip conductor), which are electrically coupled as described above by the addition or elimination of capacitors as required.

In another variation of the third embodiment of the present invention, when the distance between the input electrode 32 and the strip conductor 29 is sufficiently small, as defined by the filter characteristics, the first capacitor 18 can be replaced by the capacitance existing between the input electrode 32 and the strip conductor 29. Similarly, when the distance between the output electrode 33 and the strip conductor 31 is sufficiently small, as defined by the filter characteristics, the second capacitor 19 can be replaced by the capacitance existing between the output electrode 33 and the strip conductor 31.

In yet another variation of the third embodiment, as with the first and second capacitor 18, 19, when the distance between strip conductor 29 and strip conductor 30 and between strip conductor 30 and 31 is sufficiently small, as defined by the filter characteristics, the third capacitor 20 and the fourth capacitor 21 can be replaced by the capacitance existing between the respective strip conductors. Also, capacitors 22, 23 and 24 can be replaced by the capacitance existing between the second ground conductor 34 and the respective strip conductor 29, 30, 31, when the distance between the ground conductor 34 and the respective strip conductor 29, 30, 31 is sufficiently small, as defined by the filter characteristics.

Figure 4:
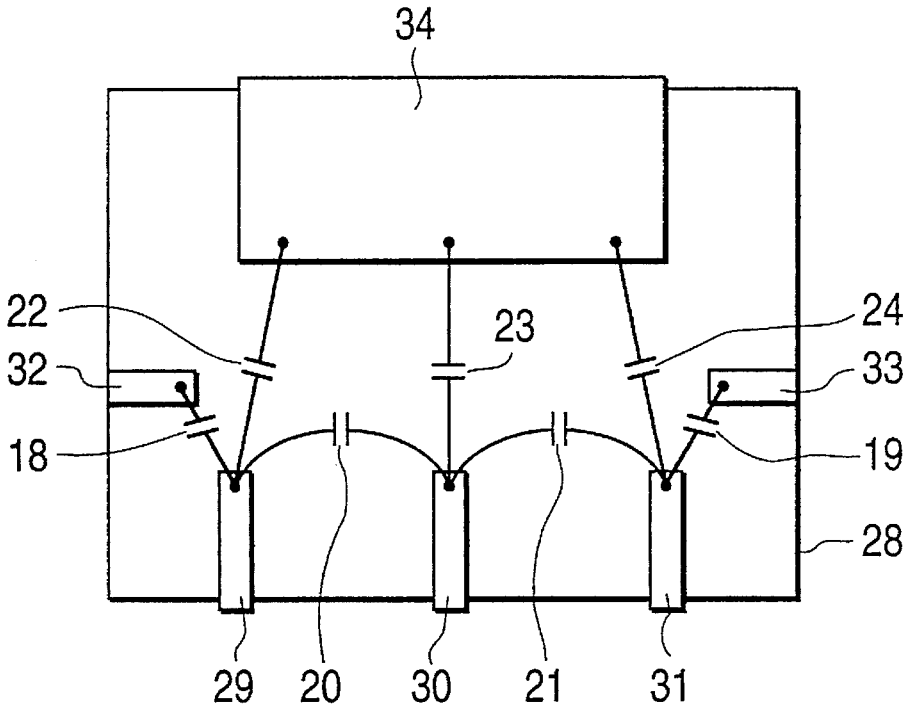
FIG. 4 is a schematic plan view of the structure of a fourth embodiment of the bandpass filter of the present invention.

A fourth embodiment of the bandpass filter of the present invention is illustrated in FIG. 4, wherein elements equivalent to those disclosed in the third embodiment are designated by the same number. As is apparent, the structure of the fourth embodiment of the filter is the same as the structure of the third embodiment of the filter. The difference between the two embodiments is that in the fourth embodiment the capacitors 22, 23 and 24 which electrically couple the strip conductors 29, 30 and 31 to the second ground conductor 34 have different capacitive values. More specifically, capacitor 23 which couples strip conductor 30 to the second ground conductor 34 has a larger capacitive value than capacitors 22 and 24, and the strip conductor 30 exhibits a proportional reduction in length. The length of the strip conductor 30 is reduced so as to decrease the inductive component of the filter such that the resonant frequency of filter, which is a function of both the inductive and capacitive components, remains at the desired value.

The frequency response of the filter of the fourth embodiment of the present invention is substantially equivalent to the frequency response of the filter of the third embodiment.

Figure 6:
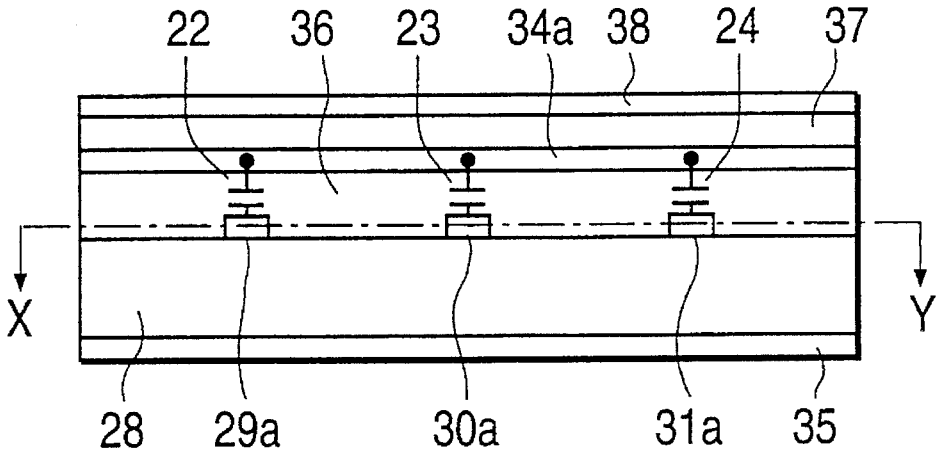
FIG. 6 is a schematic front view of the structure of a fifth embodiment of the bandpass filter of the present invention.
Figure 7:
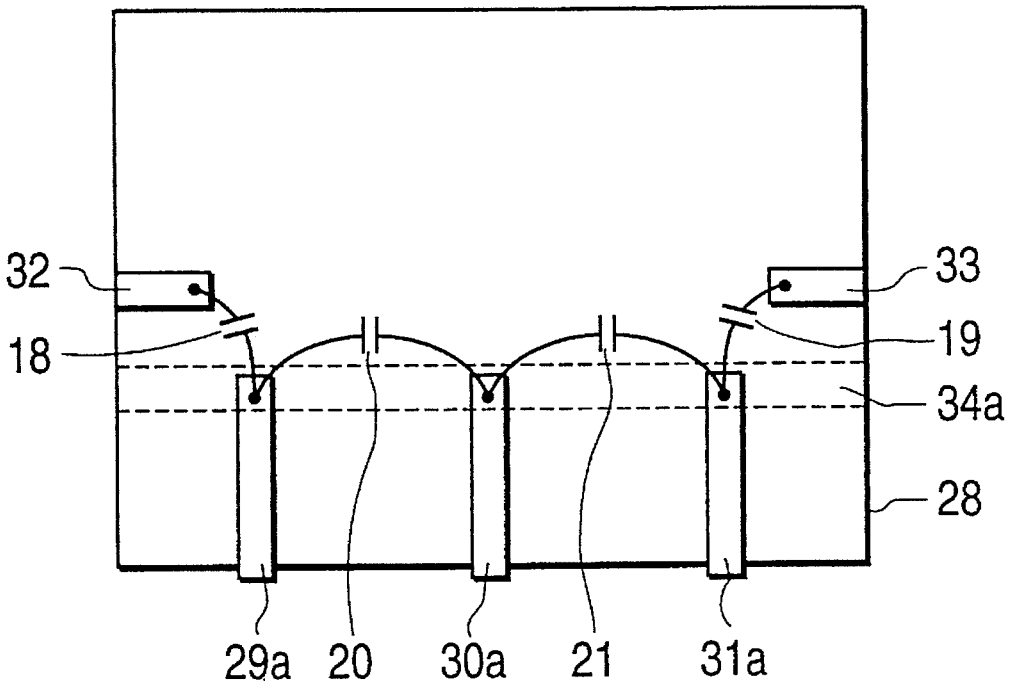
FIG. 7 is a cross sectional view of the fifth embodiment of the present invention taken along the line X—Y of FIG. 6.

FIGS. 6 and 7 illustrate a fifth embodiment of the bandpass filter of the present invention, which comprises a plurality of substrates arranged in layers. Specifically, FIG. 6 is a front view of the structure of the fifth embodiment of the filter, and FIG. 7 is a cross-sectional view of the structure of the fifth embodiment of the filter taken along line X—Y of FIG. 6.

As shown in FIG. 6, the filter comprises three strip conductors 29*a*, 30*a*, and 31*a*, an input electrode 32, and an output electrode 33, all of which are disposed on the upper surface of a first substrate 28 formed from a dielectric substance. A ground conductor 35 is disposed on the lower surface of the first substrate 28.

The filter further comprises a second substrate 36 formed from a dielectric substance which is disposed on the upper surface of the first substrate 28. A ground conductor 34*a* is formed on the second substrate 36 so as to extend across the distal ends of the strip conductors 29*a*, 30*a*, 31*a* as denoted by the broken lines in FIG. 7. In other words, the ground conductor 34*a* is separated from the respective distal ends of the strip conductors 29*a*, 30*a*, 31*a* by the second substrate 36. The combination of a strip conductor 29*a*, 30*a* or 31*a* separated from a ground conductor 34*a* by the second dielectric substrate 36 is a microstrip waveguide resonator. An additional dielectric layer 37 and a ground conductor 38 are formed on the ground conductor 34*a*. Strip conductors 29*a*–31*a*, ground conductors 35 and 38, and dielectric substrates 28 and 37 form the resonator.

Capacitors 18–24 are arranged and operate in the same manner as the corresponding capacitors disclosed in the first embodiment of the present invention. More specifically, the strip conductor 29*a* and the input electrode 32 are electrically coupled through a first capacitor 18. Strip conductor 31*a* and the output electrode 33 are electrically coupled through a second capacitor 19. Strip conductor 30*a* is electrically coupled with strip conductors 29*a* and 31*a* by a third capacitor 20 and a fourth capacitor 21, respectively.

Each strip conductor 29*a*, 30*a*, 31*a* is also electrically coupled to the second ground conductor 34*a* through a capacitor 22, 23, 24. Specifically, as shown in FIG. 6, strip conductor 29*a* is coupled to the second ground conductor 34*a* via capacitor 22. Strip conductor 30*a* is coupled to the second ground conductor 34*a* via capacitor 23. And strip conductor 31*a* is coupled to the second ground conductor 34*a* via capacitor 24.

The frequency response of the filter of the fifth embodiment of the present invention is substantially equivalent to the frequency response of the filter of the first embodiment.

Similar to the other embodiments of the present invention, the filter of the fifth embodiment is not limited to a structure comprising three strip conductors. Variations of the fifth embodiment are possible wherein the filter may comprise any number of strip conductors (including a single strip conductor), which are electrically coupled by the addition or elimination of capacitors as described above.

Figure 8:
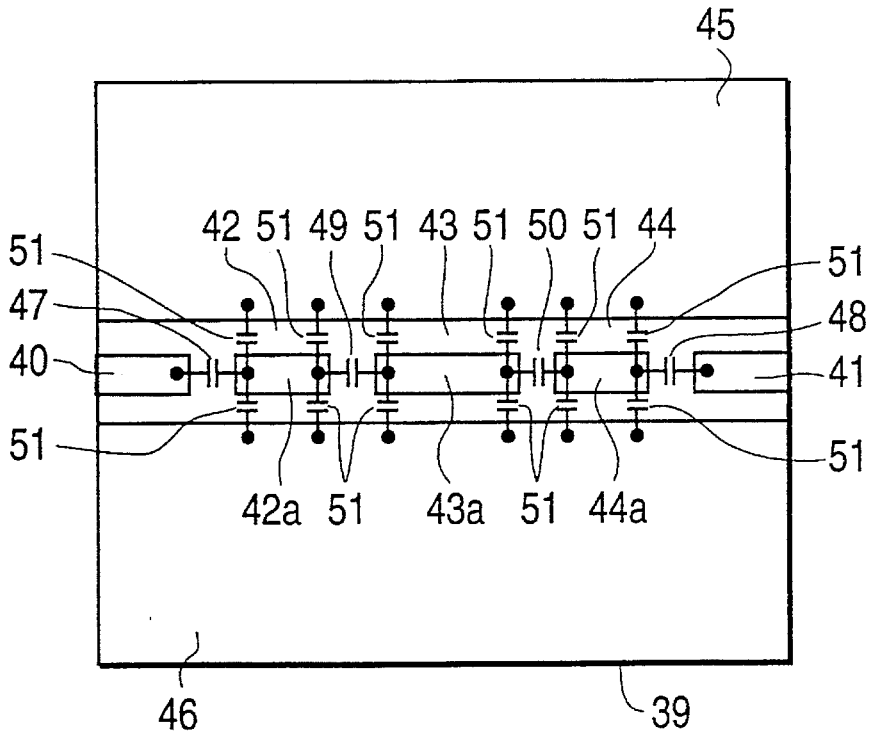
FIG. 8 is a schematic plan view of the structure of a sixth embodiment of the bandpass filter of the present invention.

Referring to FIG. 8, a sixth embodiment of the bandpass filter of the present invention is described. FIG. 8 is a plan view of a primary part of the structure of a ½ wavelength filter employing the filters of the present invention. The ½ wavelength filter comprises an input electrode 40, an output electrode 41 and three coplanar waveguide resonators 42, 43 and 44, all of which are disposed on a substrate 39 formed from a dielectric substance.

Each coplanar waveguide resonator 42, 43, 44 comprises a strip conductor 42*a*, 43*a*, 44*a*, having a flat bar shape, and ground conductors 45 and 46 disposed opposite each other on both sides of the strip conductors 42*a*, 43*a*, 44*a*. As shown in FIG. 8, the input electrode 40 is electrically coupled to one end of the first strip conductor 42*a* through a capacitor 47, and the other end of the first strip conductor 42*a* is electrically coupled to a first end of the second strip conductor 43*a* through a capacitor 49. The other end of the second strip conductor 43*a* is electrically coupled to a first end of the third strip conductor 44*a* through a capacitor 50, and the other end of the third strip conductor 44*a* is electrically coupled to the output electrode 41 through a capacitor 48.

Each strip conductor 42*a*, 43*a*, 44*a* are also electrically coupled to the ground conductors 45 and 46 located adjacent both sides of the strip conductors 42*a*, 43*a*, 44*a* through a plurality of capacitors 51. Specifically, as shown in FIG. 8, each end of the strip conductors 42*a*, 43*a*, 44*a* is connected to both ground conductor 45 and ground conductor 46 through a separate capacitor 51. The present embodiment requires twelve capacitors 51 to couple the three strip conductors 42*a*, 43*a*, 44*a* to the ground conductors 45, 46.

Figure 9:
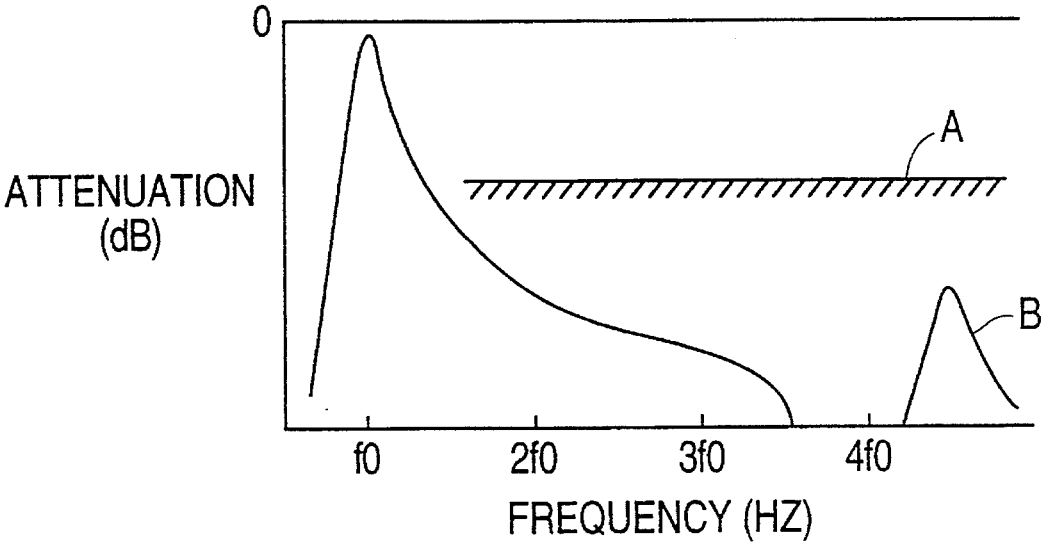
FIG. 9 is a graph illustrating the frequency response of the bandpass filter of the sixth embodiment of the present invention.

FIG. 9 is a diagram of the frequency response of the ½ wavelength filter shown in FIG. 8. Referring to FIG. 9, the line designated by the letter "A" represents the minimum level of attenuation acceptable for signals having a frequency outside a predefined frequency bandwidth of the filter, and the letter "B" designates a harmonic component of the center frequency of the filter. As is apparent, the frequency response of the filter is such that the attenuation of the harmonic components of the center frequency of the filter does not decrease until the higher order harmonics (i.e., the harmonic component "B" in FIG. 9). However, the higher order harmonic component is substantially outside the required bandwidth of the filter, and more importantly, does not exceed the minimum level of attenuation designated by the letter "A".

The increased attenuation of the harmonic components is a function of electrically coupling each end of the strip conductors 42*a*, 43*a*, 44*a* to both ground conductors 45 and 46. In addition, this coupling also provides a filter which preserves the electrical phase stability of a signal.

It is of note that it is theoretical possible to obtain the same frequency response as shown in FIG. 9 with the ½ wavelength filter described in FIG. 8 modified so that each end of the strip conductors 42*a*, 43*a*, 44*a* is electrically coupled to either ground conductor 45 or ground conductor 46 through capacitor 51. However, in practice, such an embodiment of the ½ wavelength filter results in a loss of the electrical phase balance thereby impairing an otherwise acceptable frequency response.

Variations of the sixth embodiment of the present invention are possible. For example, the ½ wavelength filter may comprise any number of strip conductors (including a single strip conductor), wherein each strip conductor is electrically coupled to the adjacent strip conductor and to ground conductor 45 and ground conductor 46 by the addition or elimination of capacitors as described above with reference to FIG. 8.

Figure 10:
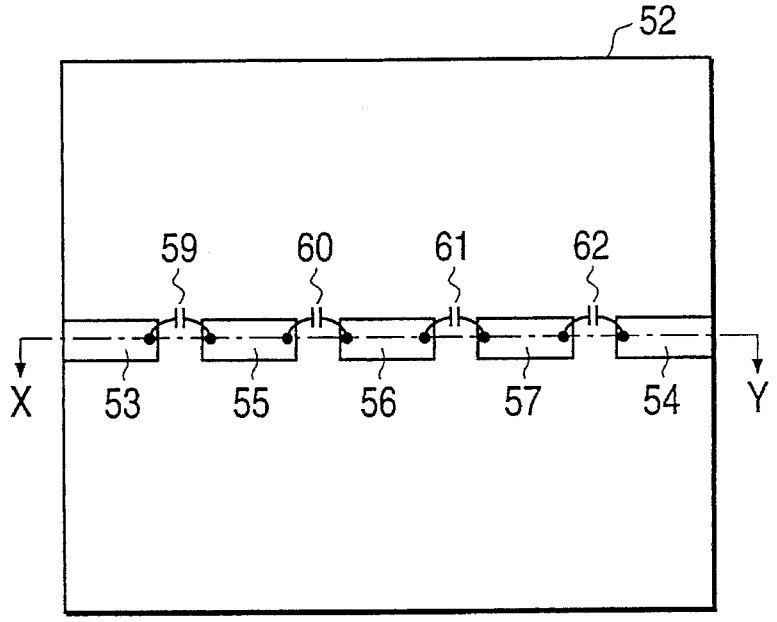
FIG. 10 is a schematic plan view of the structure of a seventh embodiment of the bandpass filter of the present invention.
Figure 11:
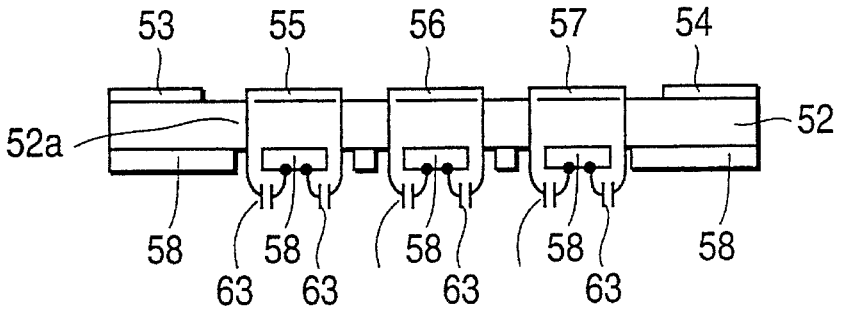
FIG. 11 is a cross sectional view of the seventh embodiment of the present invention taken along the line X—Y of FIG. 10.
Figure 12:
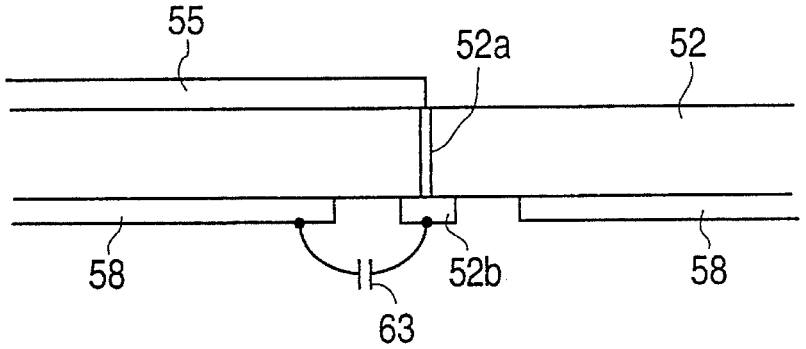
FIG. 12 is an enlarged front view of the primary part the seventh embodiment of the present invention illustrated in FIG. 11.

Referring now to FIGS. 10–12, a seventh embodiment of the bandpass filter of the present invention is described. FIG. 10 is a schematic plan view of a primary part of the structure of a ½ wavelength filter employing strip conductors. FIG. 11 is a cross sectional view of the ½ wavelength filter taken along line X—Y of FIG. 10. FIG. 12 is an enlarged view of a portion of FIG. 11.

As shown in FIGS. 10–12, the ½ wavelength filter comprises an input electrode 53, an output electrode 54 and three strip conductors 55, 56 and 57, which are linearly disposed at specified intervals on the upper surface of a substrate 52 formed from a dielectric substance. As shown in FIG. 12, the dielectric substrate 52 comprises a plurality of through holes 52*a* which extend from the upper surface of the substrate 52 to the lower surface (i.e. opposite) of the substrate 52. The holes 52*a* are located on the substrate 52 such that when the strip conductors 55, 56, 57 are disposed on the substrate 52, a single hole 52*a* underlies each end of the strip conductors 55, 56, 57.

On the lower surface of the substrate 52, each hole 52*a* is covered by an electrode 52*b* formed on the lower surface of the dielectric substrate 52. The filter also comprises a plurality of ground conductors 58 disposed on the lower surface of the substrate 52. The ground conductors 58 are positioned opposite the input electrode 53, the output electrode 54, and each of the three strip conductors 55, 56, 57. However, as shown in FIGS. 11–12, the ground conductor 58 does not extend the entire length of the corresponding strip conductor 55, 56, 57 disposed on the upper surface of the substrate 52, because each ground conductor 58 is separated from the electrode 52*b* which is formed directly beneath the ends of each strip conductor 55, 56, 57.

As shown in FIG. 10, the input electrode 53 is electrically coupled to a first end of strip conductor 55 through a first capacitor 59, and the opposite end of the strip conductor 55 is electrically coupled to a first end of strip conductor 56 through capacitor 60. In a similar fashion, the opposite end of strip conductor 56 is electrically coupled to a first end of strip conductor 57 through capacitor 61, and the opposite end of strip conductor 57 is electrically coupled to the output terminal 54 through capacitor 62. Also, as shown in FIG. 11, each ground conductor 58 positioned beneath a strip conductor 55, 56, 57 is electrically coupled to the two adjacent lower electrodes 52*b* through separate capacitors 63.

The frequency response of the filter of the seventh embodiment of the present invention is substantially equivalent to the frequency response of the filter of the sixth embodiment.

Similar to the sixth embodiment of the present invention, the filter of the seventh embodiment is not limited to a structure comprising three strip conductors. Variations of the seventh embodiment are possible wherein the filter may comprise any number of strip conductors (including a single strip conductor), which are electrically coupled by the addition or elimination of capacitors and strip conductors as described above.

In each of the aforementioned embodiments of the present invention, the physical dimensions of the filter components vary in accordance with factors including the dielectric constant of the substrate, the selected center frequency of the filter, and the value of capacitor coupling the resonator to the second ground conductor.

Figure 13:
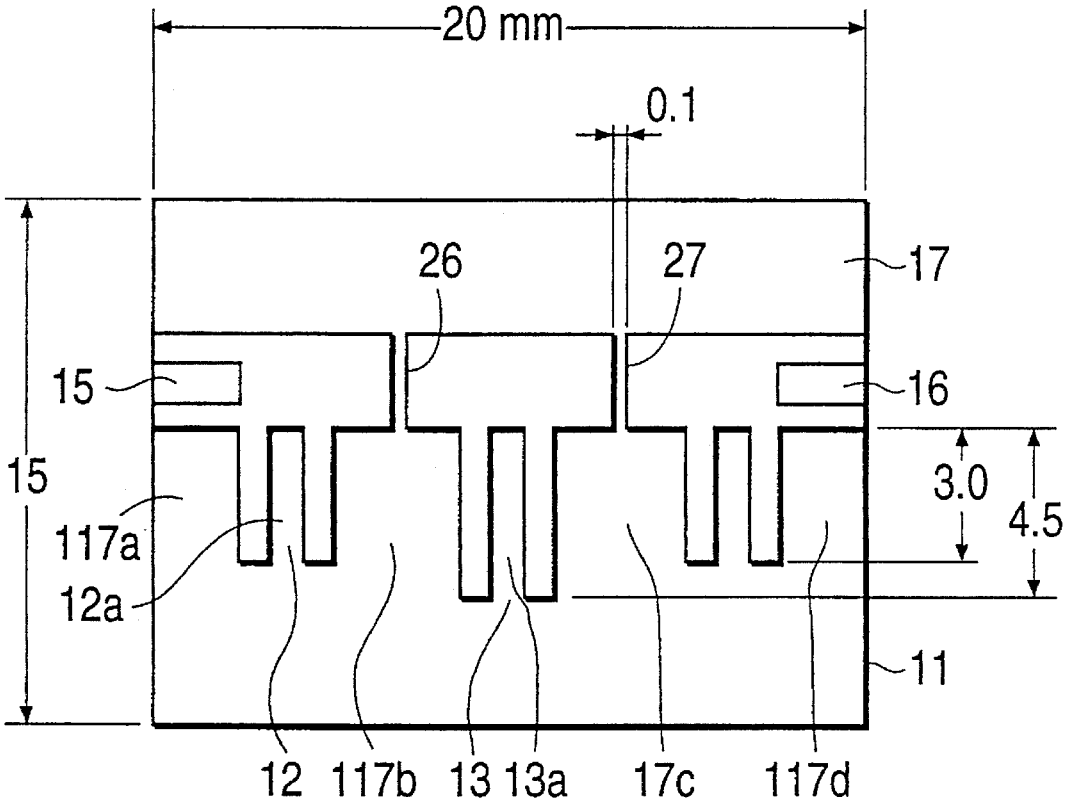
FIGS. 13 and 14 illustrate physical dimensions of the filter components of an exemplary filter formed according to the first embodiment of the present invention.
Figure 14:
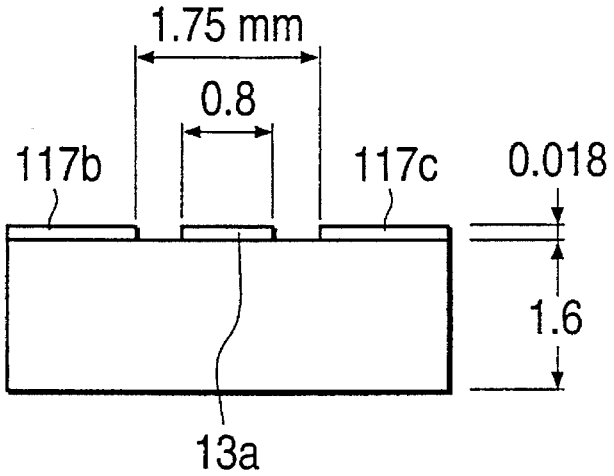
Figure 15:
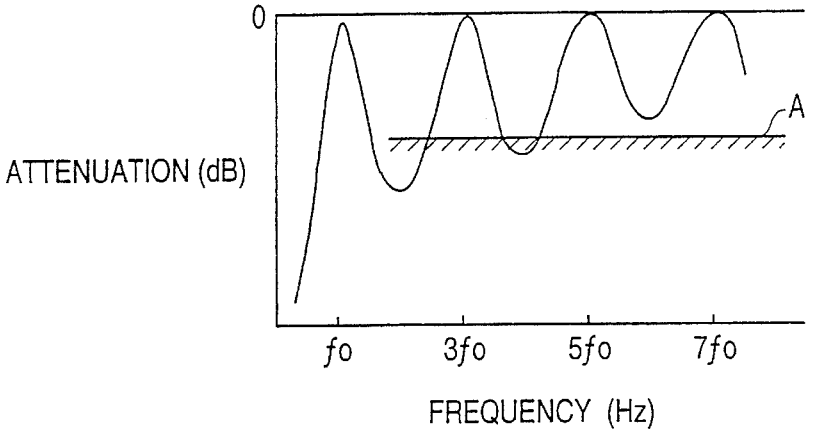
FIG. 15 PRIOR ART
FIG. 15 is a graph illustrating the frequency response of the a prior art bandpass filter.
Figure 16:
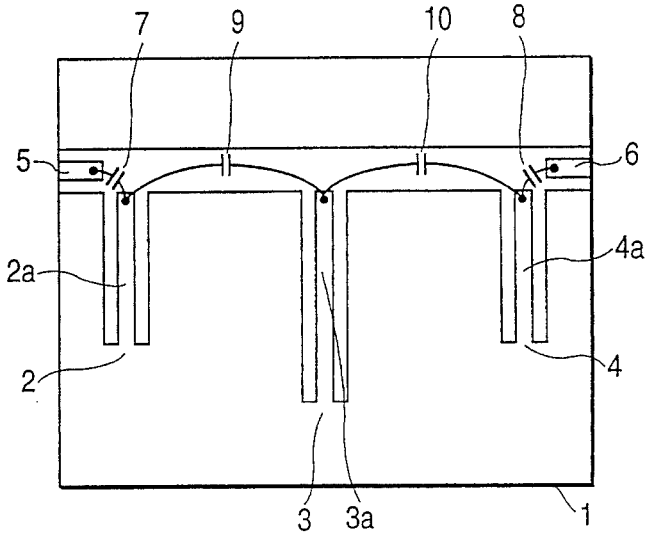
FIG. 16 PRIOR ART
FIG. 16 is a schematic plan view of the structure of a prior art bandpass filter.

FIGS. 13 and 14 illustrate the physical dimensions of the filter components of an exemplary filter formed according to the first embodiment of the present invention. This filter has a center frequency of 1 Ghz. As is apparent, the dielectric substrate 11 measures 20 mm in width, 15 mm in length and 1.6 mm in thickness. Strip conductors 12*a* and 14*a* measure 3.0 mm in length, while strip conductor 13*a* measures 4.5 mm in length. All three strip conductors 12*a*, 13*a*, 14*a* measure 0.8 mm in width and 0.018 mm in thickness. The distance between the first ground conductors, for example 117*b* and 117*c*, measures 1.75 mm. The distance between the strip conductors, for example 12*a* and 13*a*, measures 6.0 mm. The distance between the input electrode 15 and strip conductor 12*a* measures 1.5 mm, as does the distance between the output electrode 16 and strip conductor 14*a*. As previously stated, all of the aforementioned dimensions vary in accordance with the desired filter performance.

The embodiments described above provide significant advantages over the prior art bandpass filters. For example, because the strip conductors forming the coplanar waveguide resonator are electrically coupled to the ground conductor through capacitors, the resultant filter provides increased attenuation of the harmonic components of the center frequency of the filter. As a result, the bandpass filter of the present invention substantially reduces the transmission of unwanted noise, thereby enhancing the performance of systems utilizing bandpass filters, such as television receivers and cellular phones.

Another advantage of the present invention is that the elements of the bandpass filter (i.e. resonators, electrodes, ground planes) can be formed on a single plane, which significantly simplifies the production process. Yet another advantage is that the design of the present invention allows for a reduction in the length of the resonator, which thereby allows for a reduction in the overall size of the device.

Of course, it should be understood that a wide range of changes and modifications can be made to the preferred embodiments described above. It is therefore intended that the foregoing detailed description be regarded as illustrative rather than limiting, and that it be understood that it is the following claims, including all equivalents, which are intended to define the scope of this invention.

What is claimed is:

1. A band pass filter for the transmission of signals within a predetermined frequency bandwidth having a center frequency, said filter comprising:

a dielectric substrate, an input electrode formed on a surface of said dielectric substrate, an output electrode formed on a surface of said dielectric substrate, a first ground conductor formed on a surface of said dielectric substrate to define an edge, said first ground conductor having at least one cavity extending inwardly from said edge of said first ground conductor, said at least one cavity having an inner edge, a strip conductor extending outwardly from said inner edge of said at least one cavity, said strip conductor having an outer edge aligned in a straight line with said edge of said first ground conductor, thereby forming at least one coplanar waveguide resonator, a second ground conductor formed on a surface of said dielectric substrate, a first capacitor electrically coupling said input electrode and said strip conductor forming said at least one coplanar waveguide resonator, a second capacitor electrically coupling said output electrode and said strip conductor forming said at least one coplanar waveguide resonator, and at least one further capacitor electrically coupling said second ground conductor and said strip conductor forming said at least one coplanar wavequide resonator, wherein harmonic components of the center frequency of said filter are substantially transmitted to ground through said further capacitor to prevent transmission of said harmonic components by said filter.

2. A bandpass filter according to claim 1, wherein said first ground conductor has a plurality of cavities extending inwardly from said edge of said first ground conductor, each of said cavities having an inner edge, a strip conductor extending outwardly from said inner edge of each cavity, having an outer edge aligned in a straight line with said edge of said first conductor, thereby forming a plurality of coplanar waveguide resonators, said first capacitor electrically coupling said input electrode and a strip conductor forming one of said plurality of waveguide resonators, said second capacitor electrically coupling said output electrode and another strip conductor forming another of said plurality of waveguide resonators, said at least one further capacitor includes a further capacitor for each further waveguide resonator, with said further capacitor electrically coupling said second ground conductor to a further strip conductor forming a further waveguide resonator of said plurality of waveguide resonators, wherein each said further waveguide resonator is electrically coupled to said second ground conductor by a further capacitor, and further comprising, additional capacitors, wherein an additional capacitor of said additional capacitors electrically couples said strip conductor forming said one of said plurality of waveguide resonators to a further strip conductor forming a further waveguide resonator, and another additional capacitor of said additional capacitors electrically couples said another strip conductor forming said another of said plurality of waveguide resonators to a further strip conductor forming a further waveguide resonator, with any further strip conductor being electrically coupled to another strip conductor by a further additional capacitor of said additional capacitors, whereby each strip conductor is electrically coupled to another strip conductor by an additional capacitor.

3. A bandpass filter according to claim 2, wherein the capacitive value of each said further capacitor electrically coupling said second ground conductor and a strip conductor depends on the desired center frequency of the filter, wherein the center frequency of said bandpass filter can be adjusted by varying the capacitive value of each said further capacitor.

4. A bandpass filter according to claim 2, wherein the inductive value of each coplanar waveguide resonator depends on the length of each said strip conductor and the desired center frequency of the filter, wherein the center frequency of said bandpass filter can be adjusted by Varying the length of each said strip conductor.

5. A bandpass filter according to claim 2, further comprising, an extending ground conductor for each portion of said first ground conductor formed between a pair of said strip conductors electrically coupling said each portion to said second conductor for preventing the transmission of noise and preventing a coupling capacitance between said a pair of said strip conductors.

6. A bandpass filter according to claim 5, wherein the length and width of each extending ground conductor depends on the desired amount of noise suppression.

7. A band pass filter for the transmission of signals within a predetermined frequency bandwidth having a center frequency, said filter comprising:

a dielectric substrate, an input electrode formed on a surface of said dielectric substrate, an output electrode formed on a surface of said dielectric, substrate a ground conductor formed on a surface of said dielectric substrate to define an edge, said ground conductor having at least one cavity extending inwardly from said edge of said ground conductor, said at least one cavity having an inner edge, a strip conductor extending outwardly from said inner edge of said at least one cavity, said strip conductor having an outer edge aligned in a straight line with said edge of said ground conductor, thereby forming at least one coplanar waveguide resonator, a first capacitor electrically coupling said input electrode and said strip conductor forming said at least one coplanar waveguide resonator, a second capacitor electrically coupling said output electrode and said strip conductor forming said at least one coplanar wavequide resonator, and at least one further capacitor electrically coupling said ground conductor and said strip conductor forming said at least one coplanar wavequide resonator, wherein harmonic components of the center frequency of said filter are substantially transmitted to ground through said further capacitor to prevent transmission of said harmonic components by said filter.

8. A bandpass filter according to claim 7, wherein said ground conductor has a plurality of cavities extending inwardly from said edge of said ground conductor, each of said cavities having an inner edge, a strip conductor extending outwardly from said inner edge of each cavity, having an outer edge aligned in a straight line with said edge of said conductor, thereby forming a plurality of coplanar waveguide resonators, said first capacitor electrically coupling said input electrode and a strip conductor forming one of said plurality of waveguide resonators, said second capacitor electrically coupling said output electrode and another strip conductor forming another of said waveguide resonators, said at least one further capacitor includes further capacitor for each further waveguide resonator, with a said further capacitor electrically coupling said ground conductor to a further strip conductor forming a further waveguide resonator of said plurality of waveguide resonators, wherein each said further waveguide resonator is electrically coupled to said ground conductor by a further capacitor, and further comprising, additional capacitors wherein an additional capacitor of said additional capacitors electrically couples said strip conductor forming said one of said plurality of waveguide resonators to a further strip conductor forming a further waveguide resonator, and another additional capacitor of said additional capacitors electrically couples said another strip conductor forming said another of said plurality of waveguide resonators to a further strip conductor forming a further waveguide resonator, with any further strip conductor being electrically coupled to another strip conductor by a further additional capacitor of said additional capacitors, whereby each strip conductor is electrically coupled to another strip conductor by an additional capacitor.

9. A bandpass filter according to claim 8 wherein the capacitive value of each said further capacitor electrically coupling said ground conductor and a strip conductor depends on the desired center frequency of the filter, wherein the center frequency of said bandpass filter can be adjusted by varying the capacitive value of each said further capacitor.

10. A bandpass filter according to claim 8, wherein the inductive value of each coplanar waveguide resonator depends on the length of each said strip conductor and the desired center frequency of the filter, wherein the center frequency of said bandpass filter can be adjusted by varying the length of each said strip conductor.

11. A band pass filter for the transmission of signals within a predetermined frequency bandwidth having a center frequency, said filter comprising:

a first dielectric substrate with a first surface defining an edge, an input electrode formed on said first surface of said first dielectric substrate, an output electrode formed on said first surface of said first dielectric substrate, a first ground conductor formed on a second surface of said first dielectric substrate, at least one microstrip waveguide resonator having a strip conductor shaped as a flat bar, having one end terminated at said edge of said first surface of said first dielectric substrate and connected to said first ground conductor, a second dielectric substrate disposed over said first surface of said first dielectric substrate, said second dielectric substrate having a first and a second surface, said first surface of said first dielectric substrate facing said first surface of said second dielectric substrate, a second ground conductor shaped as a bar formed on said second surface of said second dielectric substrate and positioned above the other end of the strip conductor, a first capacitor electrically coupling said input electrode and the other end of said strip conductor forming said at least one microstrip waveguide resonator, a second capacitor electrically coupling said output electrode and the other end of said strip conductor forming said at least one microstrip waveguide resonator, and at least one further capacitor for adjusting the center frequency of said filter, said at least one capacitor electrically coupling said second ground conductor and the other end of said strip conductor forming said at least one microstrip waveguide resonator, wherein harmonic components of the center frequency of said filter are substantially transmitted to ground through said further capacitor to prevent transmission of said harmonic components by said filter.

12. A bandpass filter according to claim 11, wherein, said at least one microstrip waveguide resonator includes a plurality of said microstrip waveguide resonators, each waveguide having a strip conductor shaped as a flat bar, each strip conductor having one end terminating at said edge of said first surface of said first dielectric and connected to said first ground conductor, said first capacitor electrically coupling said input electrode and the other end of a strip conductor forming one of a plurality of said waveguide resonators, said second capacitor electrically coupling said output electrode and the other end of another strip conductor forming another of a plurality of said waveguide resonators, said at least one further capacitor includes a further capacitor for each further waveguide resonator, with said further capacitor electrically coupling said second qround conductor to said other end of a further strip conductor forming a further waveguide resonator of said plurality of waveguide resonators, wherein each said further waveguide resonator is electrically coupled to said second ground conductor by a further capacitor, and further comprising, additional capacitors, wherein an additional capacitor of said additional capacitors electrically couples said other end of said a strip conductor forming said one of said plurality of waveguide resonators to said other end of a further strip conductor forming a further waveguide resonator, and another additional capacitor of said additional capacitors electrically couples said other end of said another strip conductor forming said another of said plurality of waveguide resonators to said other end of a further strip conductor forming a further waveguide resonator, with the other end of any further strip conductor being electrically coupled to the other end of another strip conductor by a further additional capacitor of said additional capacitors, whereby each strip conductor is electrically coupled to another strip conductor by an additional capacitor.

13. A bandpass filter according to claim 12, wherein the capacitive value of each said further capacitor electrically coupling said second ground conductor and a strip conductor depends on the desired center frequency of the filter, wherein the center frequency of said bandpass filter can be adjusted by varying the capacitive value of each said further capacitor.

14. A bandpass filter according to claim 12, wherein the inductive value of each microstrip waveguide resonator depends on the length of each said strip conductor and the desired center frequency of the filter, wherein the center frequency of said bandpass filter can be adjusted by varying the length of each said strip conductor.

15. A band pass filter for the transmission of signals within a predetermined frequency bandwidth having a center frequency, said filter comprising:

a dielectric substrate, an input electrode formed on a first surface of said dielectric substrate, an output electrode formed on said first surface of said dielectric substrate, at least one coplanar waveguide resonator having a strip conductor disposed on said first surface of said dielectric substrate in a straight line between said input electrode and said output electrode, said strip conductor having an end and an other end a first ground conductor formed on said first surface of said dielectric, a second ground conductor formed on said first surface of said dielectric, said first and second ground conductors disposed opposite each other on both sides of said straight line including a strip conductor, said input electrode and said output electrode, a first capacitor electrically coupling said input electrode to said strip conductor forming said at least one coplanar waveguide resonator at an end adjacent said input electrode, a second capacitor electrically coupling said output electrode to said strip conductor forming said at least one coplanar waveguide resonator at an other end adjacent said output electrode, and four capacitors for each strip conductor, a first of said four capacitors electrically coupling an end of a strip conductor to said first ground conductor, a second of said four capacitors electrically coupling an end of a strip conductor to said second ground conductor, a third of said four capacitors electrically coupling an other end of a strip conductor to said first ground conductor, and a fourth of said four capacitors electrically coupling an other end of a strip conductor to said second ground conductor, wherein harmonic components of the center frequency of said filter are substantially transmitted to ground through said further capacitors to prevent transmission of said harmonic components by said filter.

16. A bandpass filter according to claim 15, wherein, said at least one coplanar waveguide resonator includes a plurality of said coplanar waveguide resonators, each waveguide resonator having a strip conductor disposed on said first surface of said dielectric substrate in a straight line between said input electrode and said output electrode, and further comprising, additional capacitors, wherein an additional capacitor of said additional capacitors electrically couples an end of said strip conductor forming said one of said plurality of waveguide resonators to an other end of a further strip conductor forming a further waveguide resonator, and another additional capacitor of said additional capacitors electrically couples an end of said another strip conductor forming said another of said plurality of waveguide resonators to an other end of a further strip conductor forming a further waveguide resonator, with an end of any further strip conductor being electrically coupled to one other end of another strip conductor by a further additional capacitor of said additional capacitors, whereby each strip conductor is electrically coupled to another strip conductor by an additional capacitor.

17. A bandpass filter according to claim 16, wherein the capacitive value of each capacitor of said four capacitors electrically coupling the ground conductors and a strip conductor depends on the desired center frequency of the filter.

18. A bandpass filter according to claim 16, wherein the inductive value of each coplanar waveguide resonator depends on the length of each said strip conductor and the desired center frequency of the filter, said length differing for at least two strip conductors.

19. A band pass filter for the transmission of signals within a predetermined frequency bandwidth having a center frequency, said filter comprising:

a dielectric substrate having a plurality of holes extending from a first surface to a second opposite surface of said dielectric substrate, an input electrode formed on said first surface of said dielectric substrate, an output electrode formed on said first surface of said dielectric substrate, at least one waveguide resonator having a strip conductor, disposed on said first surface of said dielectric substrate in a straight line between said input electrode and said output electrode said strip conductor having an end and an other end with each end of said strip conductor disposed adjacent a hole in said dielectric substrate, a ground conductor formed on a second surface of said dielectric, a first capacitor electrically coupling said input electrode to said strip conductor forming said at least one waveguide resonator at an end adjacent said input electrode, a second capacitor electrically coupling said output electrode to said strip conductor forming said at least one waveguide resonator at an other end adjacent said output electrode, and two capacitors for each strip conductor, a first of said two capacitors electrically coupling an end of a strip conductor through a hole to said ground conductor, and a second of said two capacitors electrically coupling an other end of a strip conductor through a hole to said ground conductor, wherein harmonic components of the center frequency of said filter are substantially transmitted to ground through said further capacitor to prevent transmission of said harmonic components by said filter.

20. A bandpass filter according to claim 19, wherein, a said at least one waveguide includes a plurality of said waveguides, each waveguide having a strip conductor disposed on said first surface of said dielectric substrate in a straight line between said input electrode and said output electrode, and further comprising, additional capacitors,wherein an additional capacitor of said additional capacitors electrically couples an end of said strip conductor forming said one of said plurality of waveguide resonators to an other end of a further strip conductor forming a further waveguide resonator, and another additional capacitor of said additional capacitors electrically couples an end of said another strip conductor forming said another of said plurality of waveguide resonators to an other end of a further strip conductor forming a further waveguide resonator, with an end of any further strip conductor being electrically coupled to one other end of another strip conductor by a further additional capacitor of said additional capacitors, whereby each strip conductor is electrically coupled to another strip conductor by an additional capacitor.

21. A bandpass filter according to claim 20, wherein the capacitive value of each capacitor of said two capacitors electrically coupling said ground conductor and a strip conductor depends on the desired center frequency of the filter.

22. A bandpass filter according to claim 20, wherein the inductive value of each waveguide resonator depends on the length of each said strip conductor and the desired center frequency of the filter, said length differing for at least two strip conductors.

* * * * *